United States Patent [19]

Schwarz

[11] Patent Number: 5,027,540

[45] Date of Patent: Jul. 2, 1991

[54] MECHANICAL GRAPHICAL DISPLAY SYSTEM

[76] Inventor: Fred M. Schwarz, 162 Butler Dr., Glastonbury, Conn. 06003

[21] Appl. No.: 313,158

[22] Filed: Feb. 21, 1989

[51] Int. Cl.[5] ..... G09F 11/00

[52] U.S. Cl. ..... 40/490; 40/491; 273/281; 273/282

[58] Field of Search ..... 40/490, 491; 273/241, 273/289, 290, 281, 153 R, 153 S, 307, 282

[56] References Cited

U.S. PATENT DOCUMENTS

| | | | |
|---|---|---|---|
| 1,142,777 | 6/1915 | Star | 40/618 |
| 1,459,937 | 5/1921 | Teipel | 273/153 S |
| 1,859,755 | 9/1931 | Thompson | 40/620 |
| 2,305,047 | 12/1942 | Wagner . | |
| 2,544,445 | 3/1951 | Corzilius . | |
| 3,124,885 | 3/1964 | Mendell . | |
| 3,358,395 | 12/1967 | Simnovic | 40/489 |
| 3,362,093 | 1/1968 | Joselevich | 40/452 |
| 3,419,979 | 1/1969 | McVicker et al. . | |
| 3,458,944 | 8/1969 | Jimenez . | |
| 3,532,317 | 6/1968 | Adler | 40/618 X |
| 3,755,938 | 9/1973 | Bytwork . | |
| 4,165,576 | 8/1979 | Joselevich | 40/620 X |
| 4,505,061 | 3/1985 | Neuburger et al. | 40/489 |
| 4,654,101 | 3/1987 | Kane . | |
| 4,669,210 | 6/1987 | VanErum . | |
| 4,694,596 | 9/1987 | Fast | 40/622 |

FOREIGN PATENT DOCUMENTS

| | | | |
|---|---|---|---|
| 3242495 | 5/1984 | Fed. Rep. of Germany | 273/153 S |
| 2404882 | 6/1979 | France | 40/618 |
| 81/00162 | 1/1981 | PCT Int'l Appl. | 40/618 |
| 1181674 | 9/1986 | U.S.S.R. | 273/153 S |

*Primary Examiner*—Laurie K. Cranmer
*Assistant Examiner*—J. Bonifanti
*Attorney, Agent, or Firm*—Ira S. Dorman

[57] ABSTRACT

A graphical display system utilizes an array of base units, which are disengageably affixed to one another so as to form a base board of variable extent, having a grid of slots in the front face thereof. Cover pieces have elements for slidably engaging them upon the front face of the base board, enabling them to be shifted in both of two mutually perpendicular directions within the grid of slots. The cover pieces are of various sizes and dimensions, and appropriate decorative or characterizing elements are applied to their surfaces to permit use for creating effective graphical display components.

20 Claims, 4 Drawing Sheets

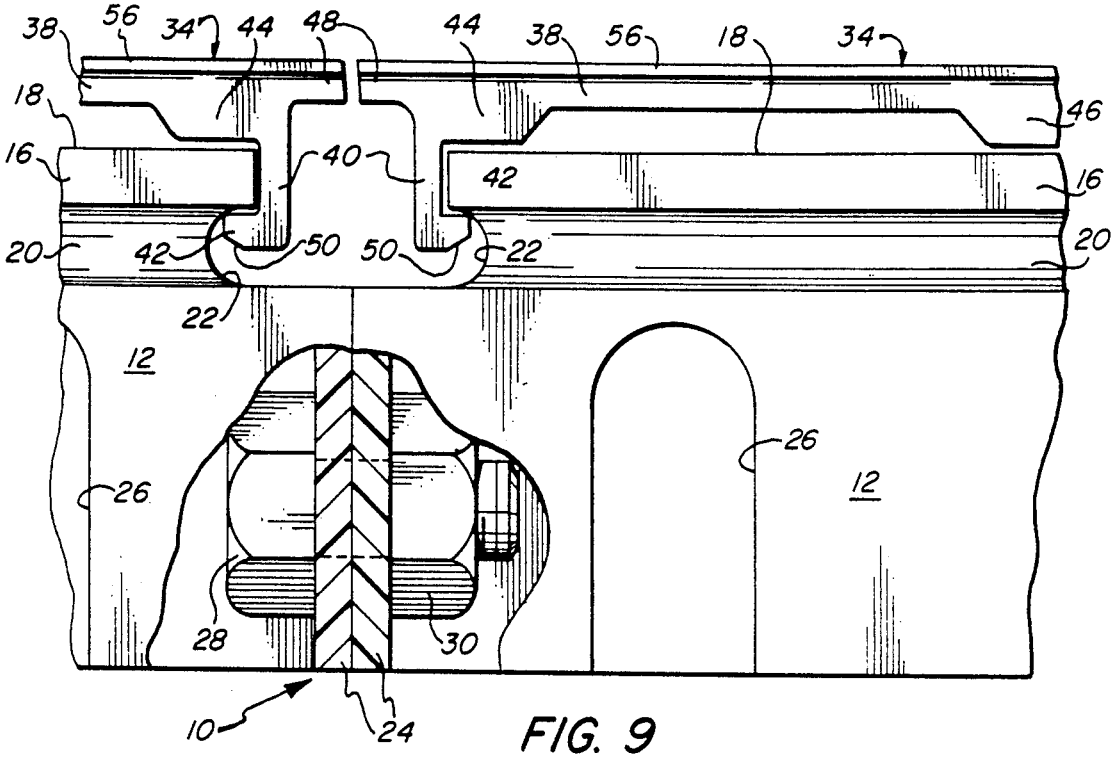
FIG. 9
FIG. 10
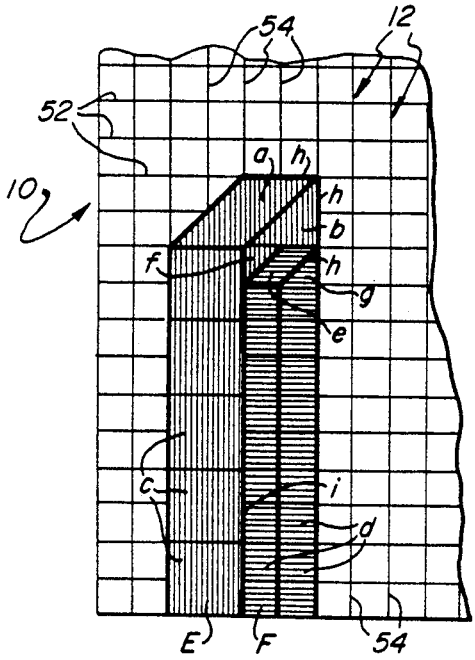
FIG. 10A
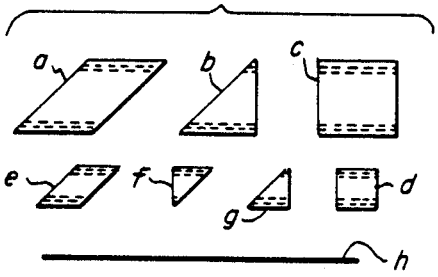

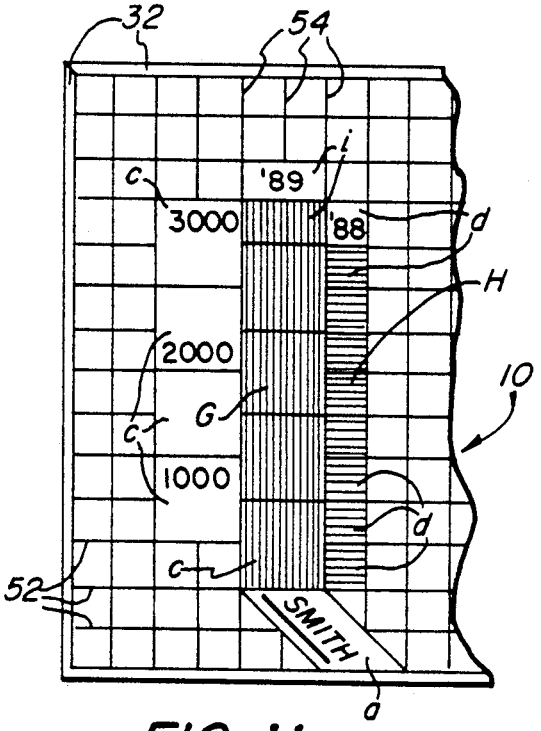
FIG. 11
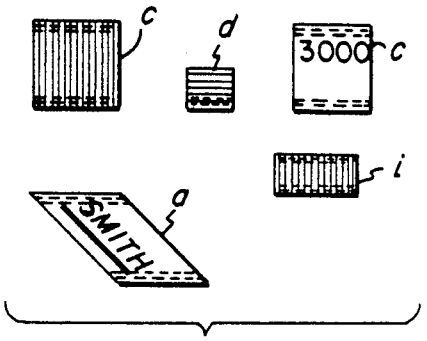
FIG. 11A
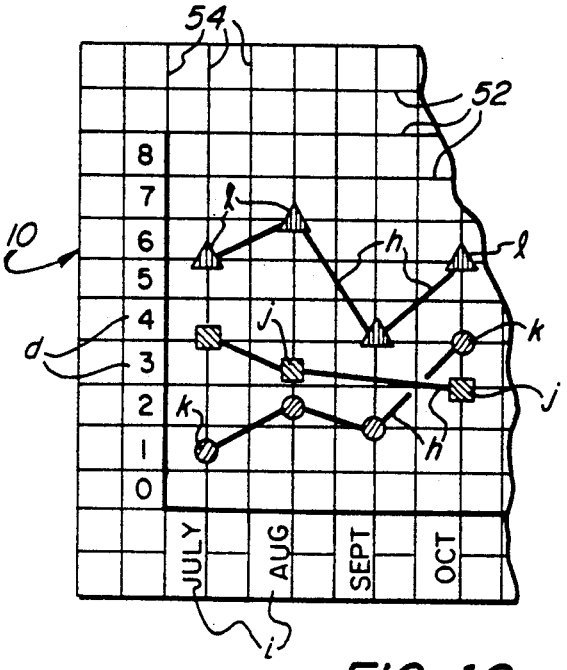
FIG. 12
FIG. 12A
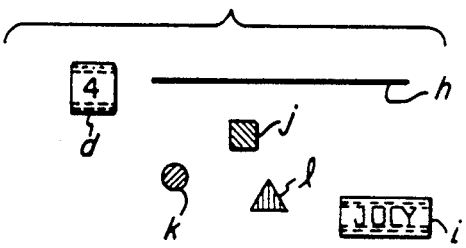

MECHANICAL GRAPHICAL DISPLAY SYSTEM

BACKGROUND OF THE INVENTION

Graphs and charts are used extensively in business, industry and academe, as well as in the home, to graphically represent many different kinds of data and a wide diversity of situations and relationships. The information to be presented is often of a dynamic nature, requiring that changes be made from time to time if an accurate representation is to be maintained. Frequently however, only part of the graph or chart is to be revised, and it is therefore highly desirable for such a display to offer the capability of quick and easy rearrangement and alteration, while also enabling previously established graphic features to be preserved and updated. As indicated by the following U.S. patents, the prior art fails to do so in an optimal manner:

Wagner U.S. Pat. No. 2,305,047 shows a display sign constructed from an array of cubic glass blocks or other building elements, some of which are provided with angled carrier members to form a ledge for supporting sign letters.

U.S. Pat. No. 2,544,445, to Corzilius, provides a production control board which utilizes a set of stacked strips, each having a dovetail groove to receive a row of inserts.

Gauge elements, which may be of different lengths, are received in parallel slots of the graphical chart display board shown in Mendell U.S. Pat. No. 3,124,885.

In accordance with McVicker et al U.S. Pat. No. 3,419,979, a number of board units are assembled alongside one another in a supporting frame to provide a pattern of parallel ribs; small plastic markers having opposed legs are snapped over the ribs to form columns, and they are described to be slidable therealong and readily removed therefrom.

Jimenez U.S. Pat. No. 3,458,944 discloses a sign construction consisting of numerous transparent plastic pockets arranged in a rectangular array on a panel, the pockets being adapted to receive inserts placed so as to form sign characters.

A visual display device, consisting of hinged panels, is provided by Bytwork U.S. Pat. No. 3,755,938; at least one of the panels has "magnetizable sheet means" secured to its inside surface, to cooperate with magnetic display members.

Kane U.S. Pat. No. 4,654,101 discloses a method for making a changeable display sign; a magnetic support is employed for securing flexible sign component pieces, the latter having undercut marginal edges to promote close interfitting.

Van Erum U.S. Pat. No. 4,669,210 provides a supporting board that is formed with horizontal "clip strips" having grooved lateral sides; cooperating plates, which may or may not be character bearing, have resilient legs for snapping into the grooves.

Accordingly, it is the broad object of the present invention to provide a novel graphical display system comprising a base board of readily variable extent, and display-forming pieces that are readily engaged upon and disengaged from the base board, and that are readily shifted thereover to different positions.

A more specific object of the invention is to provide such a system wherein a plurality of cover pieces of differing structural characteristics are employed, which pieces are adapted for assembly on the base board in a variety of arrangements so as to afford unique graphical display effects.

Additional objects of the invention are to provide such a graphical display system which is easy and convenient to utilize, is relatively uncomplicated and inexpensive to manufacture, and is adapted to provide graphical displays, such as for charts, graphs, and schedules, that are highly attractive and of strong visual impact.

SUMMARY OF THE INVENTION

It has now been found that the foregoing and related objects of the invention are readily attained by the provision of a graphical display system, comprising a base board having a flat upper face with a rectangular grid of slots thereon, and a multiplicity of cover pieces mounted on the base board for slidable movement over its upper face. The base board is comprised of a multiplicity of peripherally contiguous, substantially identical base units disengageably affixed to one another in a generally rectangular array. Each of the base units has an upper portion of rectangular peripheral configuration with a flat top face thereon, circumscribed by marginal lip elements, the top faces lying substantially in a common plane to cooperatively provide the upper face of the base board. Lower portions of the base units are disposed and configured to abut one another, and to space adjacent pairs of the marginal lip elements sufficiently from one another to define slot sections therebetween; pairs of contiguous base units are rectilinearly aligned, so that the slot sections thereof cooperatively define at least certain of the slots of the rectangular grid. The base board also includes means for fastening the peripherally contiguous base units to one another, so as to construct the array.

Each of at least certain of the cover pieces employed in the system comprises a rectangular top portion having an outwardly exposed display characteristic, and at least one engagement element depending from the top portion. The engagement element is slidably received within a slot of the base board, and is engaged under at least one of the lip elements extending along its slots. The top portion of each of the cover pieces is dimensioned and configured to substantially cover at least a section of the upper portion of each of the base units, so that a plurality of rectilinearly aligned, contiguous cover pieces may cooperatively provide an integrated display component comprised of the top portions thereof.

Normally, the grid of slots and the peripheral configuration of the upper portions of the base units will be square. The upper portions of the base units may desirably be subdivided, by slot portions, into a plurality of rectangular sections, each circumscribed by marginal lip elements; such sections may also desirably be of square peripheral configuration, with four of them being present on each of the base units.

The lower portion of each of the base units will usually comprise a rectangular frame of rectilinear flange elements depending from and extending peripherally about the upper portion thereof. The outer edge of each of the marginal lip elements on the base unit will advantageously lie slightly inwardly of the outermost surface of the flange element disposed directly below it, and each such element will usually be of continuous length, except for an opening that is adapted to receive a fastener component. The system will normally include a multiplicity of such components, received in the flange element openings, to provide the required fastening means; typically, they will take the form of threadably interengaged nuts and bolts.

In most instances the cover pieces will have a pair of parallel legs, one depending along each of two opposite edges of the panel, to provide the engagement elements. The legs may have inwardly facing beads extending along the free, lower edges thereof, the beads being disposed to engage under the lip elements of the base units when the panel of the cover piece is seated upon its top face. In the preferred embodiments, the cover pieces will be fabricated from a synthetic resinous material that exhibits sufficient resilient deflectability to permit snap-fitting engagement with the lip elements of the base units.

The system may include a first plurality of cover pieces having top portions dimensioned to substantially fully cover the upper portions of the base pieces, and a second plurality of cover pieces having top portions that are dimensioned to cover only one of the sections thereof. It may additionally include a plurality of cover pieces having top portions of parallogrammatic configuration, and others having top portions of triangular configuration. At least certain of the cover pieces will advantageously have a web element secured to a surface of its top portion, thus providing the desired display characteristic thereon or coloration thereto.

BRIEF DESCRIPTION OF THE DRAWINGS

FIG. 9 is a fragmentary edge view of a system embodying the present invention, with part of the lower portions of the contiguous pair of base units broken away to show internal features;

FIG. 10 is a fragmentary plan view showing a section of a system embodying the invention, with various cover pieces arranged to depict a set of two bar-like graphical components;

FIG. 10A is a plan view showing cover pieces and an element utilized to produce the graphical components depicted in FIG. 10; and FIGS. 11, 11A, 12 and 12A are comparable to FIGS. 10 and 10A, and show other graphical displays that the system of the invention may present, and constituent elements thereof.

DETAILED DESCRIPTION OF THE ILLUSTRATED EMBODIMENTS

Figure 1:
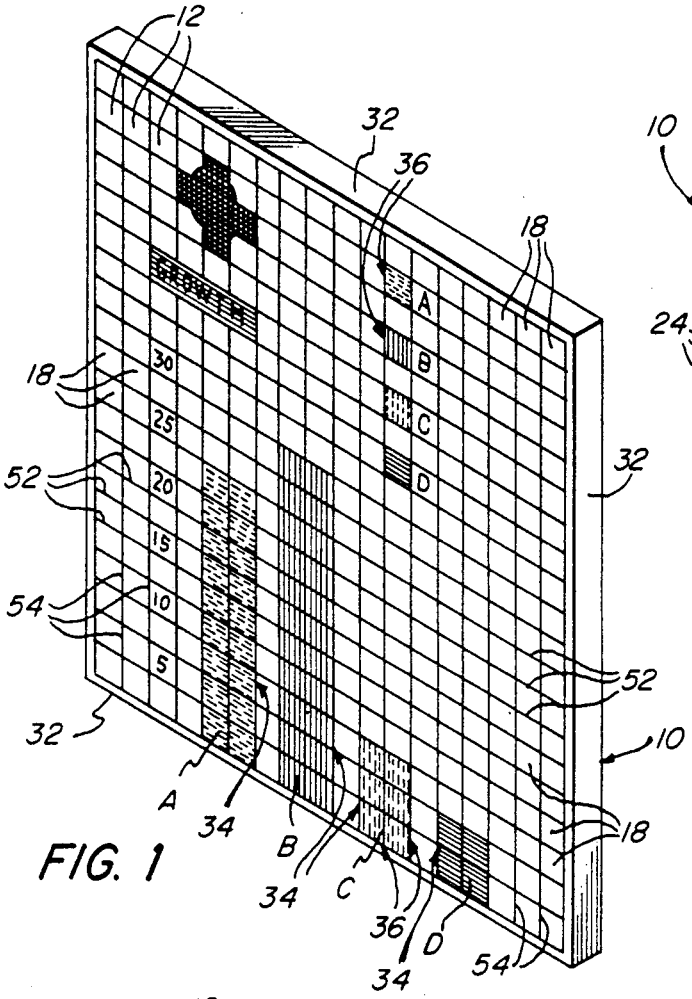
FIG. 1 is a perspective view of a graphical display system embodying the present invention.
Figure 2:
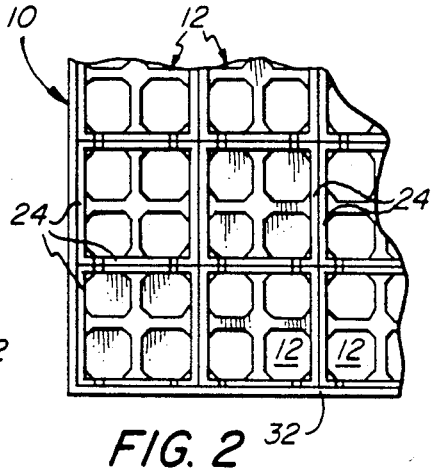
FIG. 2 is a fragmentary rear view showing a corner portion of the system of FIG. 1, drawn to an enlarged scale.
Figure 3:
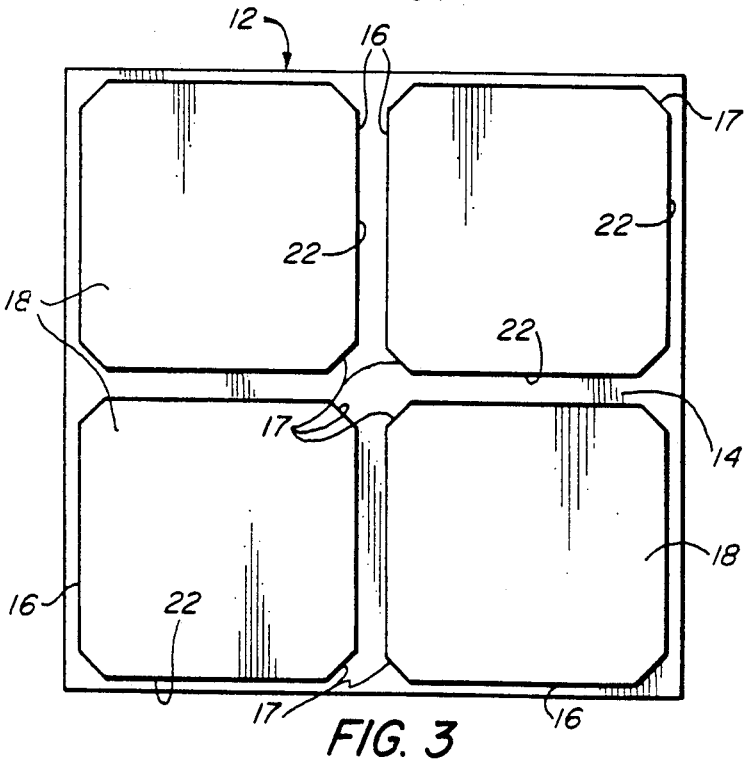
FIG. 3 is a front view of one of the units utilized to construct the base board employed in the system, drawn to a scale greatly enlarged from the scales of FIGS. 1 and 2.
Figure 4:
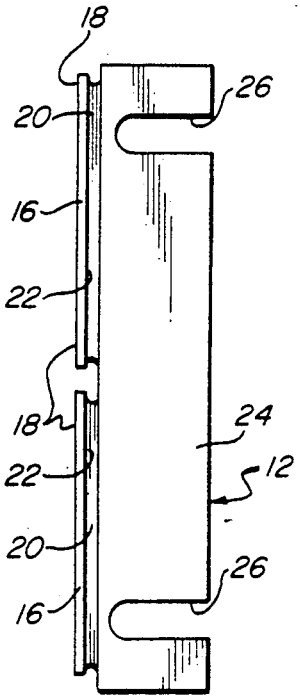
FIG. 4 is an edge view of the base unit shown in FIG. 3, drawn to the scale thereof.
Figure 5:
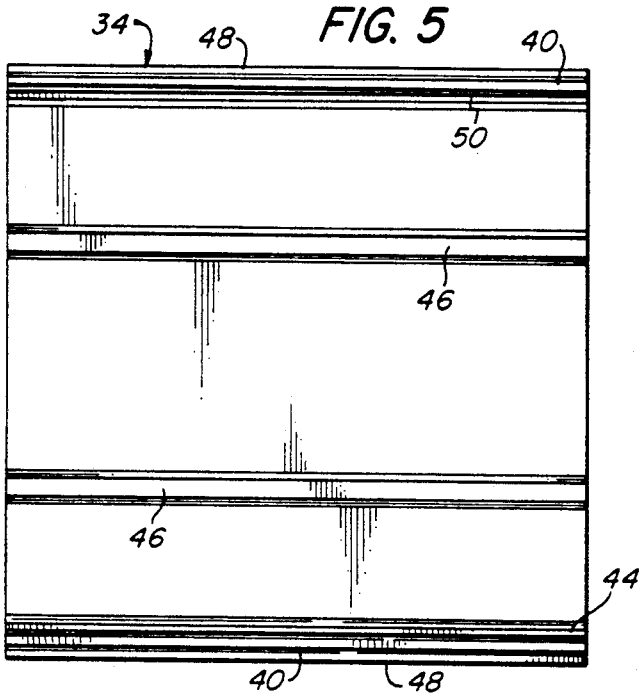
FIG. 5 is a rear view of a cover piece that is adapted for use in assembly with the base board to provide the system of the invention, drawn to the scale of FIGS. 3 and 4.
Figure 6:
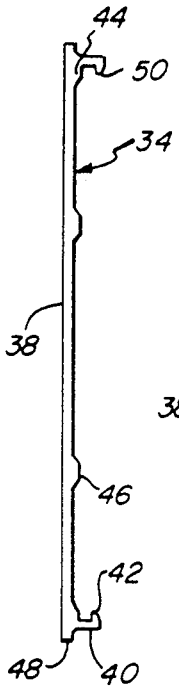
FIG. 6 is an edge view of the cover piece of FIG. 5, drawn to the scale thereof; 5, drawn to the scale thereof.
Figure 7:
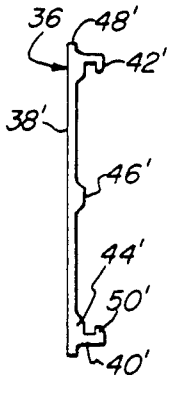
FIG. 7 is an edge view of a cover piece having one-quarter the area of the cover piece shown in FIGS. 5 and 6, and drawn to the scale thereof.

Turning now in detail to FIGS. 1–9 of the appended drawings, therein illustrated is a graphical display system embodying the present invention, and components of which the system is comprised. The base board of the system, generally designated by the numeral 10, consists of a number of individual, square base units, each generally designated by the numeral 12 and best illustrated in FIGS. 3, 4, 8 and 9.

The base units may each be integrally formed, as a single piece, from a synthetic resinous material; alternatively it may be made of several pieces bonded to one another. In any case, the base unit 12 consists of a web portion 14 with four elevated square bosses 16 thereupon. Each boss has a flat top face 18 and a riser element 20 extending peripherally thereabout and spaced inwardly from the margins thereof. This construction produces slot segments 22 circumscribing the bosses 16, which segments in turn cooperatively provide slot sections on the base unit. As can be seen, the marginal lip elements circumscribing each of the bosses 16 have relieved corners, at 17, to facilitate movement of the cover pieces thereover.

Four flanges 24 depend from the peripheral edge of the web portion 14 and define a square frame about the bottom portion of the unit 12. Two downwardly opening U-shaped indentations 26 are formed through each flange 24; as is best seen in FIG. 9, they serve to receive the bolt 28, which cooperates with nut 30 to fasten the base units to one another.

In the embodiment of FIG. 1, the base board 10 consists of ninety units so assembled in peripherally contiguous relationships to one another, to provide a $9 \times 10$ array. The base board has a flat top or forward face, cooperatively provided by the coplanar upper faces 18 of the base unit bosses 16. It is given a finished appearance by the securement of four molding strips 32 about the periphery of the array, which may be attached to the flanges 24 of the outermost base units using the indentations 26 or other appropriate means; the frame of strips 32 also serves a functional purpose, as will be pointed out below.

Square cover pieces, which are utilized to produce the graphical display upon the base board 10, are illustrated in greatest detail in FIGS. 5–9. Two different sizes are shown, the larger one, generally designated by the numeral 34, being sized to encompass an area that is four times that which is encompassed by the smaller one, which is generally designated by the numeral 36.

The larger cover piece 34 consists of a square top portion or panel 38 having a pair of legs 40 depending along, but spaced slightly inwardly from, two of its opposite edges. Each leg has an inwardly disposed bead or lip 42 extending along its free lower edge, and an elongated shoulder element along its base at the intersection with the panel 38. Two ribs 46 extend parallel to one another and to the legs 40 on the underside of the panel 38, at equidistantly spaced locations therebetween; they are of a thickness equal to that of the shoulder elements 44. Finally, relatively thin edge elements 48 provide the outermost periphery of the panel 38 in the regions over both of the legs 40.

The smaller cover piece 36 is of substantially the same construction as the larger one; the corresponding elements are therefore designated by the same numbers, but primed. Apart from the reduced area of the panel 38', and the commensurately diminished lengths of other elements, the only structural difference is that the smaller cover piece 38' has only a single rib 46', which is disposed intermediate the legs 40'.

Figure 8:
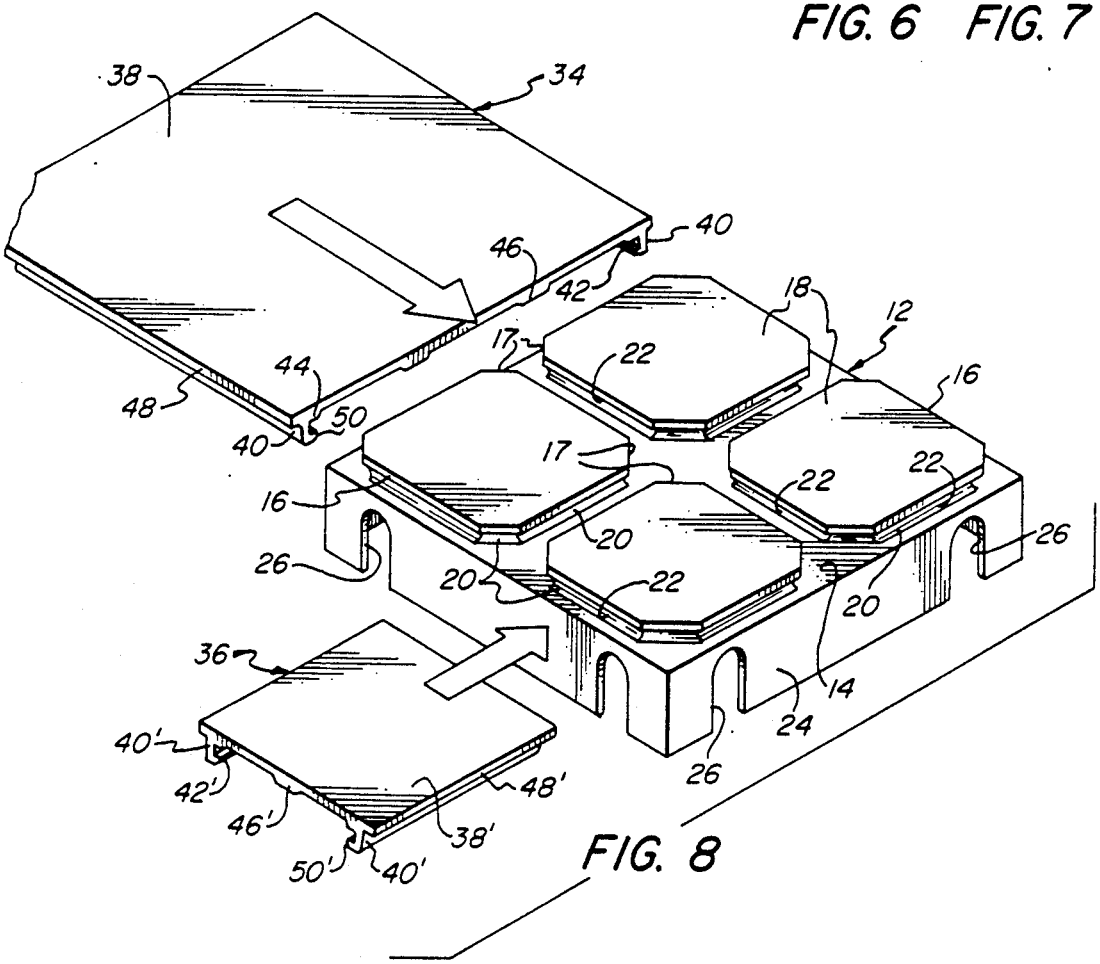
FIG. 8 is an exploded, fragmentary perspective view showing a base unit employed in the system, with both of the cover pieces illustrated in FIGS. 5–7 positioned for mounting thereupon by slideable engagement.

FIG. 8 indicates how the cover pieces 34 and 36 can be assembled with the base units 12, by slidably mounting them thereupon with the legs 40 engaging the peripheral marginal elements of the panels 18, and with the bead elements 42, disposed within the slot segments 22, hooking thereunder. Alternatively, when the cover pieces are fabricated from a resiliently deflectable material, as they normally will be, they can be snapped into place over the bosses of the base unit. It will be noted that the legs 40, 40' are champferred or relieved along their lower inner edges, and that the internal bead edges are rounded, to facilitate assembly and disassembly in that manner; it will also be appreciated that the offset construction of the legs will facilitate necessary deflection.

The cover pieces can of course be readily rotated to orientations displaced 90° from those illustrated, with engagement upon the base unit being effected in exactly the same manner. Consequently, the cover pieces can be slid over the entire length or width of the base board 10, depending upon their orientation, with their legs engaged in the lateral and transverse slots 52, 54 of the grid formed thereon.

If therefore it is assumed that each of the four columnar display components A–E shown in FIG. 1 is comprised of cover pieces 34, 36 (as appropriate) that are contiguously disposed on a transverse axis with their legs 40, 40' extending along lateral axes, it will readily be appreciated that the integrated display components can be shifted, intact, across the face of the board. This might be advantageous, for example, in instances in which a display component indicative of early data is to be eliminated, and a component indicative of later data is to be added, while preserving components therebetween that represent interim conditions. With the cover pieces oriented with their legs extending traversely, on the other hand, display components can be moved intact upwardly and downwardly over the face of the base board, as would be most appropriate when the display components extend laterally. The numerical scale, legends, and color key representations employed in the system of FIG. 1 will also be provided by appropriately dimensioned cover pieces.

Desired visual features may advantageously be integrated into the cover pieces during their manufacture. Alternatively, symbols, coloration, and other characterizations can readily be added to the cover pieces subsequently, such as by affixing to the exposed surface of their panels 38, 38' a web or other element of colored or otherwise decorated material, as indicated by element 56 shown in FIG. 9. The element may of course be applied to the underside of a transparent covering piece panel, and plural superimposed elements may be employed if so desired. Conveniently, the covering may be in the form of a thin film or sheet of plastic or paper, provided with a pressure-sensitive adhesive on one surface which may (as is conventional) be protected by a peelable backing element. As a second possibility, electrostatic forces may be relied upon to adhere vinyl elements to the panels of the cover pieces.

Turning now in detail to FIGS. 10 and 10A, therein illustrated is a system embodying the invention and providing display components E and F, and the cover pieces a–h used to create them. Components E and F are three-dimensional in appearance, and are constructed by using, in combination with two sizes of square cover pieces, the parallelogrammatic and triangular pieces shown. The strip-like element h cut to appropriate lengths, is employed to embolden the outline of the components.

The system of FIG. 11 provides a compound bar display consisting of components G and H, constructed utilizing the cover pieces shown in FIG. 11A. The parallelogrammatic piece at the bottom of the main bar G has a person's name applied to it, and date indicia are provided on cover pieces d and i at the tops of the components. The main bar G might therefore be indicative of "Smith's" performance in 1989, as compared with his or her performance in 1988, indicated by the subordinate bar H.

Finally, in FIG. 12 the cover pieces are employed essentially as carriers for the several graphic elements shown in FIG. 12A. The display provides three point-to-point curves, distinguished by use of the circular, square and triangular characters j–l, which are interconnected by strips of element h, again cut to appropriate lengths. The cover pieces i at the bottom of the base board carry lettering to designate months of the year, the ease of altering the data displayed making changes at monthly intervals entirely practical.

It will be appreciated that cover pieces having shapes other than those illustrated can be employed, as will occur to those skilled in the art. The means for engaging the cover pieces within the slots of the base board may also be quite different from the elements shown. For example, rather than utilizing pairs of legs along the margins of a cover piece, a single centralized stud, having a head engagable within the slot-defining elements, could be provided; this would enable the cover piece to be shifted universally over the face of the base board, without any need to remove it for reorientation.

The nut and bolt fasteners illustrated represent of course only one possible means for joining the base units to one another. For example, they may instead be assembled by use of double-headed studs, inserted upwardly into and frictionally engaged within the registered U-shaped indentations 26 of confronting flanges 24; alternately, clips fabricated from spring steel might advantageously serve the same purpose. The choice of appropriate fastening means will be evident to those skilled in the art, taking into account the weight that the resultant array must self-support, as well as other factors such as convenience of assembly.

The array may or may not be framed by elements such as the molding pieces 32. It may instead have a border of covering pieces (desirably, of half-width size) oriented at right angles to the direction of movement of the pieces used to create the display, as will effectively prevent them from running off the edges of the board. Finally, although not visible in the Figures, it might be noted that the base units will desirably be formed with holes or other appropriate means for securing mounting elements, such as for hanging the display system upon a wall.

Thus, it can be seen that the present invention provides a novel graphical display system comprising a base board of readily variable extent, in combination with display-forming pieces that are readily engaged upon and disengaged from the base board, and that are readily shifted to different positions thereover. More specifically, the invention provides such a system wherein a plurality of cover pieces of differing structural characteristics are employed, which pieces are adapted for assembly on the base board in a variety of arrangements so as to afford unique graphical display effects. The system is easy and convenient to utilize, is relatively uncomplicated and inexpensive to manufacture, and is adapted to provide graphical displays, such as for charts, graphs and schedules, that are highly attractive and of strong visual impact.

Having thus described the invention, what is claimed is:

1. A graphical display system comprising a base board having a flat upper face with a rectangular grid of slots thereon, and a multiplicity of cover pieces mounted on said base board for slidable movement over said upper face, said base board being comprised of a multiplicity of peripherally contiguous, substantially identical base units disengageably affixed to one another in a generally rectangular array, each of said base units having an upper portion of rectangular peripheral configuration with a flat top face thereon circumscribed by marginal lip elements, said top faces of said upper portions of said base units lying substantially in a common plane to cooperatively provide said upper face of said base board, each of said base units also having a lower portion disposed and configured to abut said lower portions of peripherally contiguous base units and comprised of a rectangular frame comprised of rectilinear flange elements depending from and extending peripherally about said upper portion thereof, said lower portions of pairs of said contiguous base units serving, in abutment, to space adjacent pairs of said marginal lip elements of said upper portions thereof sufficiently from one another as to define slot sections therebetween, a plurality of said pairs of contiguous base units being rectilinearly aligned so as to cause said slot sections thereof to cooperatively define at least certain of said slots of said rectangular grid, said base board also including means for fastening said peripherally contiguous base units to one another to construct said array; each of said cover pieces comprising a rectangular top portion having an outwardly exposed display characteristic, and at least one engagement element depending from said top portion, said engagement element being slidably received within a slot of said base board and engaged under at least one of said lip elements extending therealong, said top portion of each of said cover pieces being dimensioned to substantially cover at least a section of said upper portion of each of said base units, so that a plurality of rectilinearly aligned, contiguous cover pieces may cooperatively provide an integrated display component comprised of said top portions thereof.

2. The system of claim 1 wherein said grid of slots, and said peripheral configuration of said upper portions of said base units, are square.

3. The system of claim 1 wherein said upper portions of said base units are subdivided by slot portions into a plurality of rectangular sections, each circumscribed by such marginal lip elements.

4. The system of claim 3 wherein said upper portions and said sections thereof are of square peripheral configuration, four of said upper portion sections being present on each of said base units.

5. The system of claim 3 wherein said top portion of each of a plurality of said cover pieces is square.

6. The system of claim 5 additionally including a plurality of cover pieces each having a rectangular top portion, one dimension of said rectangular top portion being equal to the width and length of said square top portion, and the perpendicular dimension thereof being one-half the value of said square top portion dimension.

7. The system of claim 1 wherein the outer edge of each of said marginal lip elements circumscribing said upper portion of said base unit lies slightly inwardly of the outermost surface of said flange element disposed directly therebelow.

8. The system of claim 1 wherein each of said flange elements is of continuous length, save for at least one opening therethrough adapted to receive a fastener component, and wherein said system includes a multiplicity of fastener components received in said openings of said flange elements, said flange elements and fastener components comprising said means for fastening of said system.

9. The system of claim 8 wherein each said fastener component is a threaded bolt, and wherein said means for fastening includes a multiplicity of nuts engaged on said bolts.

10. The system of claim 1 wherein each of said cover pieces comprises a rectangular panel providing said top portion thereof, and a pair of parallel legs, one depending along each of two opposite edges of said panel and providing two said engagement elements thereon, each of said legs having an inwardly facing bead extending along a free, lower edge thereof and disposed to engage under said lip elements of said base units with said panel of said cover piece seated upon said top face thereof.

11. The system of claim 10 wherein said cover pieces are fabricated from a synthetic resinous material, said material exhibiting sufficient resilient deflectability to permit snap-fitting engagement of said legs of said cover pieces on said lip elements of said base units.

12. The system of claim 11 wherein the outermost periphery of said panel of each of said cover pieces, in the regions over both of said legs thereof, is provided by a relatively thin edge element extending laterally therealong beyond the associated one of said legs.

13. The system of claim 1 additionally including a plurality of cover pieces having top portions of parallogrammatic configuration.

14. The system of claim 13 additionally including a plurality of cover pieces having top portions of right triangular configuration.

15. The system of claim 1 wherein each of a plurality of said cover pieces has a web element secured to a surface of said top portion thereof providing said exposed display characteristic.

16. The system of claim 1 wherein each of a plurality of said cover pieces has a strip element secured to a surface of said top portion thereof providing at least a portion of said exposed display characteristic.

17. A graphical display system comrising a base board having a flat upper face with a rectangular grid of slots thereon, and a multiplicity of cover pieces mounted on said base board for slidable movement over said upper face, said base board being comprised of a multiplicity of peripherally contiguous, substantially identical base units disengageably affixed to one another in a generally rectangular array, each of said base units having an upper portion of rectangular peripheral configuration with a flat top face thereon circumscribed by marginal lip elements, said top faces of said upper portions of said base units lying substantially in a common plane to cooperatively provide said upper face of said base board, each of said base units also having a lower portion disposed and configured to abut said lower portions of peripherally contiguous base units, said lower portions of pairs of said contiguous base units serving, in abutment, to space adjacent pairs of said marginal lip elements of said upper portions thereof sufficiently from one another as to define slot sections therebetween, a plurality of said pairs of contiguous base units being rectilinearly aligned so as to cause said slot sections thereof to cooperatively define at least certain of said slots of said rectangular grid, said base board also including means for fastening said peripherally contiguous base units to one another to construct said array; each of said cover pieces being fabricated from a synthetic resinous material and comprising a rectangular panel providing a top portion having an outwardly exposed display characteristic, and a pair of parallel legs, one depending along each of two opposite edges of said panel, providing two engagement elements slidably received within a slot of said base board, each of said legs having an inwardly facing bead extending along a free, lower edge thereof and disposed to engage under said lip elements of said base units with said panel of said cover piece seated upon said top face thereof, said synthetic resinous material exhibiting sufficient resilient deflectability to permit snap-fitting engagement of said legs of said cover pieces on said lip elements of said base units, the outer periphery of said panel of each of said cover pieces, in the regions over both of said legs thereof, being provided by a relatively thin edge element extending laterally therealong beyond the associated one of said legs, said rectangular panel of each of said cover pieces being relatively thin over most of its area and being of increased thickness along the intersections of said legs therewith; said panel having at least one underlying rib disposed between and parallel to said legs, with said panel at said rib having a thickness equal to said increased thickness, said top portion of each of said cover pieces being dimensioned to substantially cover at least a section of said upper portion of each of said base units, so that a plurality of rectilinearly aligned, contiguous cover pieces may cooperatively provide an integrated display component comprised of said top portions thereof.

18. A graphical display system comprising a base board having a flat upper face with a rectangular grid of slots thereon, and a multiplicity of cover pieces mounted on said base board for slidable movement over said upper face, said base board being comprised of a multiplicity of peripherally contiguous, substantially identical base units disengageably affixed to one another in a generally rectangular array, each of said base units having an upper portion of rectangular peripheral configuration with a flat top face thereon subdivided by slot portions into a plurality of rectangular sections, each of said sections being circumscribed by marginal lip elements, said top faces of said upper portions of said base units lying substantially in a common plane to cooperatively provide said upper face of said base board, each of said base units also having a lower portion disposed and configured to abut said lower portions of peripherally contiguous base units, said lower portions of pairs of said contiguous base units serving, in abutment, to space adjacent pairs of said marginal lip elements of said upper portions thereof sufficiently from one another as to define slot sections therebetween, a plurality of said pairs of contiguous base units being rectilinearly aligned so as to cause said slot sections thereof to cooperatively define at least certain of said slots of said rectangular grid, said base board also including means for fastening said peripherally contiguous base units to one another to construct said array; each of said cover pieces comprising a rectangular top portion having an outwardly exposed display characteristic, and at least one engagement element depending from said top portion, said engagement element being slidably received within a slot of said base board and engaged under at least one of said lip elements extending therealong, said top portions of a first plurality of said cover pieces being dimensioned to substantially fully cover said upper portions of said base pieces, and said top portions of a second plurality of said cover pieces being dimensioned to cover only one of said sections thereof, so that a number of rectilinearly aligned, contiguous cover pieces may cooperatively provide an integrated display component comprised of said top portions thereof.

19. The system of claim 18 wherein said upper portions of said base units, and said sections thereof, are of square peripheral configuration, four of said upper portion sections being present on each of said base units.

20. The system of claim 19 wherein said top portion of each of a plurality of said cover pieces is square.

* * * * *